United States Patent [19]

Kiritani et al.

[11] 4,100,031

[45] Jul. 11, 1978

[54] PROCESS FOR PREPARING BLAST FURNACE COKES

[75] Inventors: Yoshio Kiritani, Osaka; Michio Tsuyuguchi, Wakayama, both of Japan

[73] Assignee: Sumikin Coke Company Limited, Japan

[21] Appl. No.: 756,967

[22] Filed: Jan. 4, 1977

[30] Foreign Application Priority Data

Apr. 30, 1976 [JP] Japan ..... 51-50230

[51] Int. Cl.[2] ..... C10B 47/10; C10B 53/08; C10B 57/04

[52] U.S. Cl. ..... 201/6; 201/8; 201/21; 201/23; 201/24; 201/40; 201/41

[58] Field of Search ..... 201/6, 8, 21, 23, 24, 201/41, 40

[56] References Cited

U.S. PATENT DOCUMENTS

| | | | |
|---|---|---|---|
| 3,560,346 | 2/1971 | Günter | 201/6 |
| 3,692,505 | 9/1972 | Reichl | 201/6 X |
| 3,883,399 | 5/1975 | Nire | 201/6 |
| 3,907,648 | 9/1975 | Nire et al. | 201/23 X |

FOREIGN PATENT DOCUMENTS

| | | | |
|---|---|---|---|
| 2,015,614 | 10/1971 | Fed. Rep. of Germany | 201/6 |
| 46-7375 | 2/1971 | Japan | 201/21 |

*Primary Examiner*—Morris O. Wolk
*Assistant Examiner*—Michael S. Marcus
*Attorney, Agent, or Firm*—Watson, Cole, Grindle & Watson

[57] ABSTRACT

A process for preparing blast furnace cokes which contain large amounts of low-grade coal which comprises the steps of adding a binder to a coal for making briquettes which comprises a substantially low-grade coal such as non- and/or poorly-coking coal; either alone or when blended in an amount of up to about 40% or more with a charging coal; mixing the binder and the coal briquetting the mixture in a roll press to form briquettes of two or more types; blending the resulting briquettes of different types with a charging coal in a total amount of about 35% or more of the briquettes based on the charging coal and, to prepare a blended charging coal; and carbonizing the blended charging coal in a coke oven.

8 Claims, No Drawings

PROCESS FOR PREPARING BLAST FURNACE COKES

BACKGROUND OF THE INVENTION

1. Field of the Invention

The present invention relates to a process for preparing blast furnace cokes wherein a large amount of lower-quality coals can be used.

2. Description of the Prior Art

Recently there have been many technical developments directed towards the use low-grade coals in the formulation of blast furnace cokes, i.e., coals that previously were considered not at all suitable for such use in blast furnaces. Among them, one development was to attempt to include low-grade coals in coke formulations created by briquetting a coal blended with a binder, and then blending the resulting briquettes with a coal ready for coke oven charging (simply called "after charging coal") to prepare a blended coal ready for coke oven charging (simply called "after blended charging coal"). In this technique, however, the blending ratio of the low-grade coal was restricted since the strength of the coke was decreased as the blending ratio of the low-grade coal was increased.

This can be explained as follows: When a charging coal of conventional grade is blended with briquettes, the bulk density of the blended charging coal is increased, and the strength of the coke which is obtained by carbonizing the blended charging coal is also increased as the blending ratio of the briquettes is increased, i.e., until the blending ratio of the briquettes is greater than a certain amount, in general about 50%. At this amount the spaces formed between the briquettes are not filled up sufficiently with the charging coal, and the bulk density is rather decreased, and thus the strength of the cokes are reduced.

Regarding the above situation, it must also be realized that when blending briquettes with a charging coal, the charging coal particles and the briquettes (the particles and briquettes being of course different in shape and weight) act differently when conveyed from one place to another, when placed in storage, or when taken out of storage etc., and therefore a partial segregation of briquettes in the blended charging coal occurs. For example, when a charging coal of conventional grade is blended with briquettes having an external size of 30–40mm, a weight of 30–40g and a specific gravity of about 1.2, the heavy briquettes, when conveyed, are discharged from the end of a conveyor at a greater speed than that of the charging coal particles, and when the charging coal is placed in the storage, briquettes will immediately and rapidly fall or slip down the dumped surface. Moreover, when the blended charging coal is taken out of a coal bunker for placement in a charging car, due to segregation and the slower moving speed of the briquettes in the hopper, the amount of briquettes in the bunker discharge flow will be increased at the end of the removal period. This latter observation was made during our research studies wherein a blended charging coal, obtained by uniformly blending 30% of briquettes with a charging coal, was charged into a hopper having a capacity of 70 tons, and then 2 ton portions of the blended charging coal were taken out from a discharge means 30 separate times and the amount of briquettes the in the discharge flow was determined each time. It was was determined that the amount of briquettes in the discharge flow varied in the range of 15–50% during the course of each separate coal withdrawal.

Therefore, disregarding the variation of briquettes in the subsequent charging step into the carbonization chamber of a coke oven, when the average amount of briquettes in the blended charging coal is greater than about 30%, and especially when the amount of briquettes exceeds 45–50%, the bulk density and the strength of the cokes produced are, as mentioned above, significantly decreased. For this reason, when a blending process briquettes is practiced on an industrial scale, the average amount of briquettes in the blended charging coal is generally controlled within the limit of about 30%.

Because the strength of blast furnace coke is improved by suitably selecting the amount of briquettes in the blended charging coal as described above, even when a low-grade coal, (which has hitherto been considered not suitable for the preparation of blast furnace coke) is used in the coke, an equal effectiveness of the resulting coke can be maintained by blending in briquettes. That is, low-grade coal can in general be used up to about 10–20% of the blast furnace coke by employing a process for blending in of briquettes.

As a result of our various experiments for the purpose of study on the limit content of low-grade coal in a charging coal, it was found that when blending low-grade coal in the charging coal up to an amount of about 20%, the coke obtained kept its strength when about 30% of the charging coal was briquetted. On the other hand, when the blending ratio of the low-grade coal exceeded about 20%, the coke obtained was decreased in strength at elevated temperatures even if it included blended-in briquettes. Thus, it was impossible to prepare cokes which would endure for use in modern large blast furnaces with respect to its strength at elevated temperatures when low-grade coals were blended in an amount of more than about 20%, even when a portion of this charging coal was in the form of briquettes.

Generally, low-grade coal, such as non-and/or poorly coking coal, has a high chemical activity even after being coked since its constituent carbons are arranged in a three-dimensional structure. Therefore, upon increasing the blending ratio of low-grade coal, in the charging coal the resulting coke has a high gasification speed in the blast furnace, and the embrittlement of the coke itself and its size reduction due to the load and impact within the blast furnace are promoted, which becomes a obstructing factor in operating the blast furnace.

Having thus described, by using a charging coal blended with the low-grade coal where a portion, i.e. about 30%, of the charging coal has previously been briquetted, the dense coke structure of small homogeneous pore and high specific gravity can be obtained to inhibit the chemical reactivity of the coke and to improve the embrittlement in high temperature area within the blast furnace. However, if the blending ratio of the low-grade coal becomes more than about 20%, the activation inhibitory effect by the briquettes is not exerted and the hot properties of the coke become rapidly worse.

As a result of our earnest study on the above-mentioned problems, it was found that the degradation of the hot properties of coke could be inhibited markedly even when the ratio of low-grade coal in the blended charging coal is raised to 30–40%, when the low-grade coal alone or a mixture which is obtained by blending about 40% or more, based on a charging coal, of the low-grade coal, is briquetted in its entirety, that is, the whole amount of the low-grade coal is made to exist only in the briquettes. This is opposed to the situation wherein the low-grade coal is mixed uniformly with the charging coal and then a portion of the mixture is briquetted. The advantage is due to the fact that the activation inhibitory effect by briquetting, namely the density effect of the coke structure by pressure, as well as the modification effect by the binder, have an influence on the whole particles of the low-grade coal.

However, the amount of the briquettes in a blended charging coal is limited to about 30% (as described above), so that even if the briquettes are prepared from low-grade coal alone as suggested above, it would be impossible to make the amount of the low-grade coal in the blended charging coal more than about 30%. Thus, in practice the low-grade coal is used in an amount at most of 15–20%, depending on the properties of the low-grade coal, and an increase in the amount used of the low-grade coal cannot be expected. Consequently, for the purpose of preparing cokes from such blended charging coal on an industrial scale, it is required that the variation of the briquette content resulting from the handling steps of the blended charging coal such as transportation, storage and draw out is made small and at the same time the reduction of the bulk density be inhibited.

If an improved technique were established, for effectively increasing the amount of low-grade coal in briquette-blended high quality cokes, the iron and steel industry would be very much advanced, in the sense of saving natural resources and in a financial sense. The development of such a technique is very much needed.

Therefore an object of the present invention to provide a process for preparing blast furnace cokes blended with a large amount of low-grade coal.

SUMMARY OF THE INVENTION

Such a successful technique has now been achieved by the applicants. Their technique involves adding a binder to a coal for making briquettes which is blended with about 40% or more of low-grade coal, briquetting to form briquettes of 2 or more different types (i.e. shapes or weights) blending about 35% or more of the briquettes of such plural types with a charging coal to prepare a blended charging coal, and carbonizing the blended charging coal.

DETAILED DESCRIPTION OF THE INVENTION

The present invention will now be explained in further detail. In accordance with the present invention, a coal for making briquettes, which consists of a low-grade coal such as non-and/or poorly coking coal, either alone or after blending in an amount of up to about 40% or more with a charging coal, is mixed with a desired binder and briquetted to form briquettes of 2 or more types. The blended charging coal is then prepared by blending the resulting briquettes of different types with a charging coal in a total amount of about 35% or more of the briquettes based on the charging coal, and the blended charging coal is then carbonized in a coke oven to prepare the inventive blast furnace coke.

As the low-grade coal herein used are coals considered to be unsuitable for preparing blast furnace cokes, e.g. non-coking coal and poorly coking coal which have the properties of FSI (ASTM D720, Free Selling Index) of 0–2, flowability index (JIS M 8801 5, test method of flowability (Gieseler Plastmeter) of 0–10 and total dilation index (Audibert Arnu Dilatometer) of 0. The charging coal herein used is obtained by blending suitable coals so that the charging coal has similar properties to those of conventionally known charging coal, for example volatile matters of 25–30%, FSI of 3–8 and drum index (JIS K 2151 6.2, drum test method) of $DI_{15}^{30}$ 92 or more after being carbonized. In briquetting two or more roll presses may be used wherein each roll press is provided with molds of different shapes, otherwise one roll press provided with two or more of such molds may also be used.

The binder used herein is a substance which is obtained by blending 3 to 15% by weight thereof in the coal for making briquettes so as to make a shutter index $SI_{15}^{4}$ more than 80.

Now the present invention will become more apparent from the following Examples.

The low-grade coal and the charging coal shown in Table 1 were ground so that 85% was 3mm or smaller in the former and 80% was 3mm or smaller in the latter, and then both were blended in the ratios as shown in Table 2, Group A to prepare the samples of Group A ($A_1$, $A_2$, $A_3$).

Then a portion of each sample of Group A was added to 7% of road tar having a softening point of 27° C as a binder, mixed at 40° C and briquetted in a double roll press to prepare briquettes of an average weight of 34g. 32% of the respective briquettes so obtained was blended with 68% of each sample of Group A to prepare the sample of Group B ($B_1$, $B_2$, $B_3$).

The same low-grade coal and the charging coal were blended in the ratio of 1 : 1, and then, in the similar manner as described above, added to the binder, mixed and briquetted to prepare three kinds of briquettes having an average weight of 34g, 21g and 12g. 50% of the briquettes having the weight of 34g was blended with 25% of that having the weight of 21g and 25% of that having the weight of 12g, the blended briquettes were blended with the charging coal in the ratios shown in Table 2, Group C to prepare the samples of Group C ($C_1$, $C_2$, $C_3$).

The amount of the low-grade coal in each sample was, as shown Table 2, 20%, 30% and 40%, respectively.

Table 1

| Sort | Inherent moisture | Ash | Volatile matters | FSI | Total dilation index by Audibert Arnu Dilatometer | Flowability index by Gieseler Plastometer |
|---|---|---|---|---|---|---|
| Low grade coal | 3.0% | 9.0% | 32.2% | 1 | 0% | 3 DDPM |
| Charging coal | 0.9% | 8.1% | 27.0% | 7 | 41.3% | 135 DDPM |

Table 2

| Sample No. | Group A | | Group B | | | Group C | | |
|---|---|---|---|---|---|---|---|---|
| | Charging coal | Low-grade coal | Blended coal of A | Briquettes | Low-grade coal | Charging coal | Briquettes | Low-grade coal |
| 1 | 80% | 20% | 68% | 32% | 19.6% | 55% | 45% | 21.9% |
| 2 | 70% | 30% | 68% | 32% | 29.3% | 35% | 65% | 30.5% |
| 3 | 60% | 40% | 68% | 32% | 39.1% | 15% | 85% | 39.5% |

Total 10 samples, the samples of these $A_1$–$C_3$ and one sample consisting of the charging coal alone shown in Table 1, were tested according to JIS M 8801, 5.3, Box test, the drum index was determined and the bulk reactivity of the cokes determined, and the results of these tests are shown in Table 3. The bulk reactivity was determined in order to prove the hot properties of the cokes wherein the cokes were prepared to 38–50mm, 1.5kg of which were filled in a reaction vessel and the vessel was put in a electrical furnace cylindrical. Then the temperature was raised to 950° C under a nitrogen atmosphere and at the temperature of 950° C nitrogen gas was exchanged with carbon dioxide gas which was introduced for 2 hours at a flow rate of 12l/min. During the introduction of carbon dioxide, the mixed gas, consisting of carbon dioxide and carbon mono-oxide produced by the reaction, was exhausted from the vessel, and at a predetermined interval was sampled and the volume ratio of carbon mono-oxide determined; their average value was used as the bulk reactivity.

Table 3

| Sample No. | Charging coal alone | $A_1$ | $A_2$ | $A_3$ | $B_1$ | $B_2$ | $B_3$ | $C_1$ | $C_2$ | $C_3$ |
|---|---|---|---|---|---|---|---|---|---|---|
| $DI_{15}^{30}$ | 93.9 | 88.8 | 86.8 | 84.6 | 94.7 | 94.2 | 93.4 | 94.4 | 94.2 | 94.3 |
| Bulk reactivity | 17.6 | 25.3 | 29.8 | 33.8 | 19.1 | 23.4 | 28.0 | 18.5 | 20.2 | 23.2 |
| Note | | Comparative example | | | | | | Present invention | | |

The results shown in Table 3 proved the following fact: compared with the strength of the cokes at room temperature obtained from the charging coal alone, the samples of Group A wherein the low-grade coal was merely blended were decreased in the quality of these cokes as the amount of the low-grade coal was increased and the sample No. $A_1$ wherein only 20% of low-grade coal was blended cannot be used as a blast furnace coke. The samples of Group B wherein about 30% of the briquettes were blended decreased gradually in strength as the amount of the low-grade coal increased, but there was no large difference from the strength of the cokes obtained from the charging coal alone. On the other hand, the samples of Group C in accordance with the present invention had a strength somewhat higher than the cokes from the charging coal alone, and the strength was constant and independent of the amount of the low-grade coal.

Now referring to the hot properties, that is, the bulk reactivity, which is an index representing the reactivity with carbon dioxide and the wastage degradation within the blast furnace, the samples of Group B representing the usual process for blending of briquettes were abrupted increased in their value as the amount of the low-grade coal increased and approached the values of the samples of Group A. This shows apparently that the cokes of samples B degraded remarkably within the high temperature range which is a condition normally found in blast furnaces, and the good effect by the process for effects of blending of briquettes is not sufficiently achieved. On the other hand, the samples of Group C in accordance with the present invention were subjected to the least influence by the low-grade coal blending and gave values almost equal to the reactivity of the usual charging coal alone. Thus, the present invention proved that the cokes which could bear satisfactorily to use as blast furnace cokes were prepared even when blending in about 40% of low-grade coal.

As described above, the good results shown by the samples of Group C come from the fact that the activation inhibitory effect by briquetting can have an influence on the entire low-grade coal.

EXAMPLE 2

The low-grade coal and the charging coal shown in Table 4 were ground so that 80% was 3mm or smaller and then both were blended in the ratio of 1 : 1, and from which in the same manner as in Example 1 three kinds of briquettes different in weight were prepared.

At first the briquettes of an average weight of 34g alone were blended with a charging coal in the ratio as shown in Table 5 to prepare the samples of Group D ($D_1$–$D_6$).

Then 50% of the briquettes having a weight of 34g, 25% of that having 21g and 25% of that having 12g were blended, and these blended briquettes were blended with a charging coal as shown in Table 5 to prepare the samples of Group E ($E_1$–$E_5$).

Each sample of Groups D and E was charged in a vessel having the internal dimensions of a length of 23.5cm, a width of 23.0cm and a height of 35.5cm. After falling down three times from the height of 10cm on an iron plate, the volume was determined, which represents the bulk density. Then each sample was filled up in a vessel, according to its bulk density, and carbonized in an electrical furnace. The bulk density and the drum index obtained are shown in Table 5, together with those of the charging coal alone.

Table 4

| Short | Inherent moisture | Ash | Volatile matters | FSI | Total dilation index by Audibert Arnu Dilatometer | Flowability index by Gieseler Plastometer |
|---|---|---|---|---|---|---|
| Low-grade coal | 3.5% | 8.2% | 35.1% | 1 | 0% | 4 DDPM |
| Charg- | | | | | | |

Table 4-continued

| Short | Inherent moisture | Ash | Volatile matters | FSI | Total dilation index by Audibert Arnu Dilatometer | Flowability index by Gieseler Plastometer |
|---|---|---|---|---|---|---|
| ing coal | 0.8% | 7.9% | 28.2% | 7½ | 45.7% | 213 DDPM |

Table 5

| Sample No. | Charging coal alone | $D_1$ | $D_2$ | $D_3$ | $D_4$ | $D_5$ | $D_6$ | $E_1$ | $E_2$ | $E_3$ | $E_4$ | $E_5$ |
|---|---|---|---|---|---|---|---|---|---|---|---|---|
| Blending ratio of briquettes (%) | 0 | 10 | 20 | 30 | 40 | 60 | 80 | 20 | 40 | 55 | 70 | 85 |
| Bulk density | 690 | 720 | 750 | 775 | 800 | 792 | 732 | 746 | 786 | 784 | 782 | 762 |
| $DI_{15}^{30}$ | 92.4 | 92.5 | 92.8 | 92.9 | 92.7 | 92.1 | 91.0 | 92.5 | 92.8 | 92.4 | 92.5 | 92.4 |
| Note | | Comparative example | | | | | | | Present invention | | | |

The results shown in Table 5 proved the following fact: in the samples of Group D wherein only one kind of briquette, average weight 34g, was blended with the charging coal, the bulk density was heightened as the ratio of the briquettes increased up to about 50%, the strength of the coke was superior compared with that of coke obtained from the charging coal alone (and thus the effect of the process for blending of briquettes was noticed), while in the higher blending ratio of the briquettes, the bulk density and the strength of the coke were reduced and the quality of the coke was degraded.

On the other hand, in the samples of Group E in accordance with the present invention, the increase in the bulk density was small in comparison with Group D. However, the bulk density was decreased only a little even in the large blending ratio of the briquette. Moreover the strength of the coke was almost constant within the range of the ratio of the briquette of 20–85% and was equal to that of the coke obtained from the charging coal alone. Thus, in accordance with the present invention, the considerable partial variation of the briquette within the blended charging coal had no influence on the bulk density of the blended charging coal and the strength of the coke.

In the sample of Group D it was apparent that the spaces formed between the briquettes was not filled up owing to blending a large amount of briquettes, which resulted in the remarkable lowering of the bulk density. Further, in the sample $D_4$ whose bulk density was high, while a tendency to reduce the strength of the coke was seen, it can be assumed that the distribution of the spaces before the carbonization is important. This tendency, also depending on the shape, cannot be avoided, so far as the briquette of the single shape is used. The filling up of the spaces can be made easy by existence of the briquettes of different shapes, preferrably of small shape.

Moreover, when the blending ratio of the briquettes is maintained at a same ratio, the use of the briquettes having a small unit weight means an increase in the number of briquettes blended, and the distribution of the briquettes in the charging coal becomes more uniform. Therefore, in accordance with the present invention, not only the maximum bulk density is charged into the range of the high blending ratio by the combination use of two or more kinds of briquettes of small unit weight and of different shapes and sizes, but also the distribution of the briquettes in the blended charging coal becomes more uniform and is little changed against the average blending ratio of the briquette.

The small, shaped briquettes show a slow speed of discharge from a conveyor, reduced slip and slide down, etc., compared with those of large shape, i.e., in the handling steps of conveying, storage, dumping, draw out etc., so that their segregation can be prevented within the blended charging coal.

The slip and slide down can also be reduced by forming the briquettes asymmetrically, for example egg shape, or by providing the surface thereof with a concave shape, a convex shape or with a groove.

The briquettes of plural types may be briquettes of similar shape, for example, square (such as Mashek type) such that each dimension is similar, but with differing weights; they may represent the combination of non similar shaped briquettes, for example, of square shape and the above-noted egg-shaped briquettes; and further may represent the combination of 2 or more the above similar figure briquettes and 2 or more the above non similar shaped briquettes.

Having thus described according to the present invention a process for preparing blast furnace cokes wherein a low-grade coal is blended in a large amount, it can be seen that other modifications of the invention will occur to those of skill in the art. Briquetting the low-grade coal is connected with the effect.

What we claim is:

1. A process for preparing a blast furnace coke which contains low-grade coal in a carbonizing chamber which comprises the steps of (a) adding a binder to a coal for making briquettes which contains 40% or more of a low-grade coal;

(b) forming briquettes of different shapes or weights from the binder-coal combination of step (a) to increase the bulk density and decrease segregation in the carbonizing chamber;

(c) blending the briquettes of step (b) with a charging coal such that the briquettes comprise about 35% or more of the obtained blend; and (d) carbonizing the blend of step (c) in a carbonizing chamber to prepare the blast furnace coke.

2. The process as claimed in claim 1 wherein said low-grade coal of step (a) has properties of FSI of 0–2, flowability index of 0–10 and total dilation index of 0.

3. The process as claimed in claim 1 wherein said coal for making briquettes of step (a) consists of a low-grade coal alone.

4. The process as claimed in claim 1 wherein said briquettes of step (b) comprise briquettes of similar shapes but different weights.

5. The process as claimed in claim 1 wherein said briquettes of step (b) comprise briquettes of at least two different shapes.

6. The process as claimed in claim 1 wherein said charging coal of step (c) is obtained by blending coals of volatile matters of 25–30, FSI of 3–8 and drum strength of $DI_{15}^{30}$ 92 or more after being carbonized.

7. The process as claimed in claim 1 wherein said coal for making briquettes of step (a) consists of a charging coal and a low-grade coal.

8. The process as claimed in claim 7 wherein said charging coal used for making briquettes is different in composition from said charging coal used in step (c).

* * * * *